US007270113B2

(12) United States Patent
Hervault et al.

(10) Patent No.: US 7,270,113 B2
(45) Date of Patent: Sep. 18, 2007

(54) DEVICE FOR CONTROLLING FLOW RATE OF A DIRECT INJECTION FUEL PUMP

(75) Inventors: Christian Hervault, Louvres (FR); Dominique Veret, Verrieres le Buisson (FR); Philippe Bauer, Marly le Roi (FR)

(73) Assignee: Siemens Automotive Hydraulics SA, Asnieres sur Seine (FR)

( * ) Notice: Subject to any disclaimer, the term of this patent is extended or adjusted under 35 U.S.C. 154(b) by 107 days.

(21) Appl. No.: 10/520,918

(22) PCT Filed: Jul. 8, 2003

(86) PCT No.: PCT/FR03/02118

§ 371 (c)(1),
(2), (4) Date: Jan. 11, 2005

(87) PCT Pub. No.: WO2004/007950

PCT Pub. Date: Jan. 22, 2004

(65) Prior Publication Data

US 2005/0252492 A1 Nov. 17, 2005

(30) Foreign Application Priority Data

Jul. 11, 2002 (FR) ..... 02 08726
Jul. 31, 2002 (FR) ..... 02 09797

(51) Int. Cl.
*F02M 63/02* (2006.01)

(52) U.S. Cl. ..... 123/446; 123/506; 123/511

(58) Field of Classification Search ..... 123/446, 123/447, 457, 458, 510, 514
See application file for complete search history.

(56) References Cited

U.S. PATENT DOCUMENTS

| | | | | |
|---|---|---|---|---|
| 4,574,762 | A * | 3/1986 | Muller et al. | 123/510 |
| 5,284,120 | A * | 2/1994 | Fukushima et al. | 123/510 |
| 6,102,010 | A * | 8/2000 | Isozumi et al. | 123/506 |
| 6,209,525 | B1 * | 4/2001 | Konishi et al. | 123/467 |
| 6,279,544 | B2 * | 8/2001 | Rumpf | 123/511 |
| 2003/0164161 | A1 * | 9/2003 | Usui et al. | 123/510 |

FOREIGN PATENT DOCUMENTS

| | | |
|---|---|---|
| DE | 195 39 883 | 11/1996 |
| DE | 196 12 413 | 10/1997 |
| DE | 198 53 103 | 5/2000 |
| DE | 100 58 674 | 6/2002 |
| EP | 0 974 008 | 1/2000 |
| FR | 2 767 932 | 3/1999 |

* cited by examiner

*Primary Examiner*—Thomas Moulis
(74) *Attorney, Agent, or Firm*—Young & Thompson

(57) ABSTRACT

The invention concerns a method for controlling high pressure fuel supply of a set of injectors connected to a common high pressure chamber, called common rail C in a direct injection fuel circuit, through a high pressure pump (P), by acting on the low pressure supply of said pump (P) through an electromagnetic slide valve (E), controlled by the computer managing the operating conditions of the engine which consists in providing, inside the electromagnetic valve (E) one or more internal leakage flows, either from high pressure to low pressure, or from low pressure upstream of the electromagnetic valve (E) to the low pressure downstream thereby solving the specific problems related to the three operating modes of the engine: engine brake, engine shutdown, idle speed.

9 Claims, 8 Drawing Sheets

DEVICE FOR CONTROLLING FLOW RATE OF A DIRECT INJECTION FUEL PUMP

The present invention relates to a device for controlling the flow rate of a direct injection fuel pump.

The injection system, known as DFI (Direct Fuel Injection), comprises a high pressure pump which supplies fuel under high pressure to a common chamber, conventionally designated by the expression "common rail", to which the injectors are directly connected.

Various means have been proposed to obtain a control of the flow rate of the fuel, whether gasoline or gas-oil for motors supplied by injectors: either one controls the flow rate of the pump which supplies the injectors with high pressure fuel, or one acts downstream of the pump on the high pressure circuit by recycling the excess fuel; or else one acts upstream of the pump on the admission circuit of the fuel to the pump, to let only the desired quantity of this fuel arrive at the high pressure pump.

Generally speaking, in the known supply systems for injectors for diesel engines, the high pressure pump supplies the common chamber feeding the injectors, an excess of fuel, the unconsumed fuel being then returned to the reservoir.

Devices of this type are described in the French patents 2 744 765; 2 767 932; 2 769 954 and in EP 0 974 008.

These devices have three drawbacks:

- there is a loss of energy because the pump supplies at high pressure an excess quantity of the fuel;
- the return of the unconsumed fuel at high temperature presents a supplemental risk;
- the cost of production is higher.

The present invention relates to a device for the control of the flow rate as fuel admission into the high pressure pump in a DFI system by means of which the high pressure pump will deliver to the common chamber, or to the "common rail", only very precisely the volume of fuel necessary for the operation of the motor.

But from the time at which the high pressure pump produces only the very precisely necessary quantity, it poses problems for the three following cases of operation: operation during engine braking, which is to say when there should be no fuel arriving at the injectors whilst the high pressure pump is still mechanically driven; stopping the motor, because it is then necessary to evacuate the high pressure fuel that is in the common chamber; and idling, for which a very high precision of the flow rate supplied is necessary.

The process according to the present invention consists in providing, within the electrovalve controlling the arrival of low pressure fuel to the inlet of the high pressure pump, one or several internal leakage paths either from the low pressure upstream of the electrovalve toward the downstream low pressure, or from the high pressure toward the low pressure, which permits regulating the particular problems which arise for the three following modes of operation: motor braking, motor stopping and idling.

Figure 1:
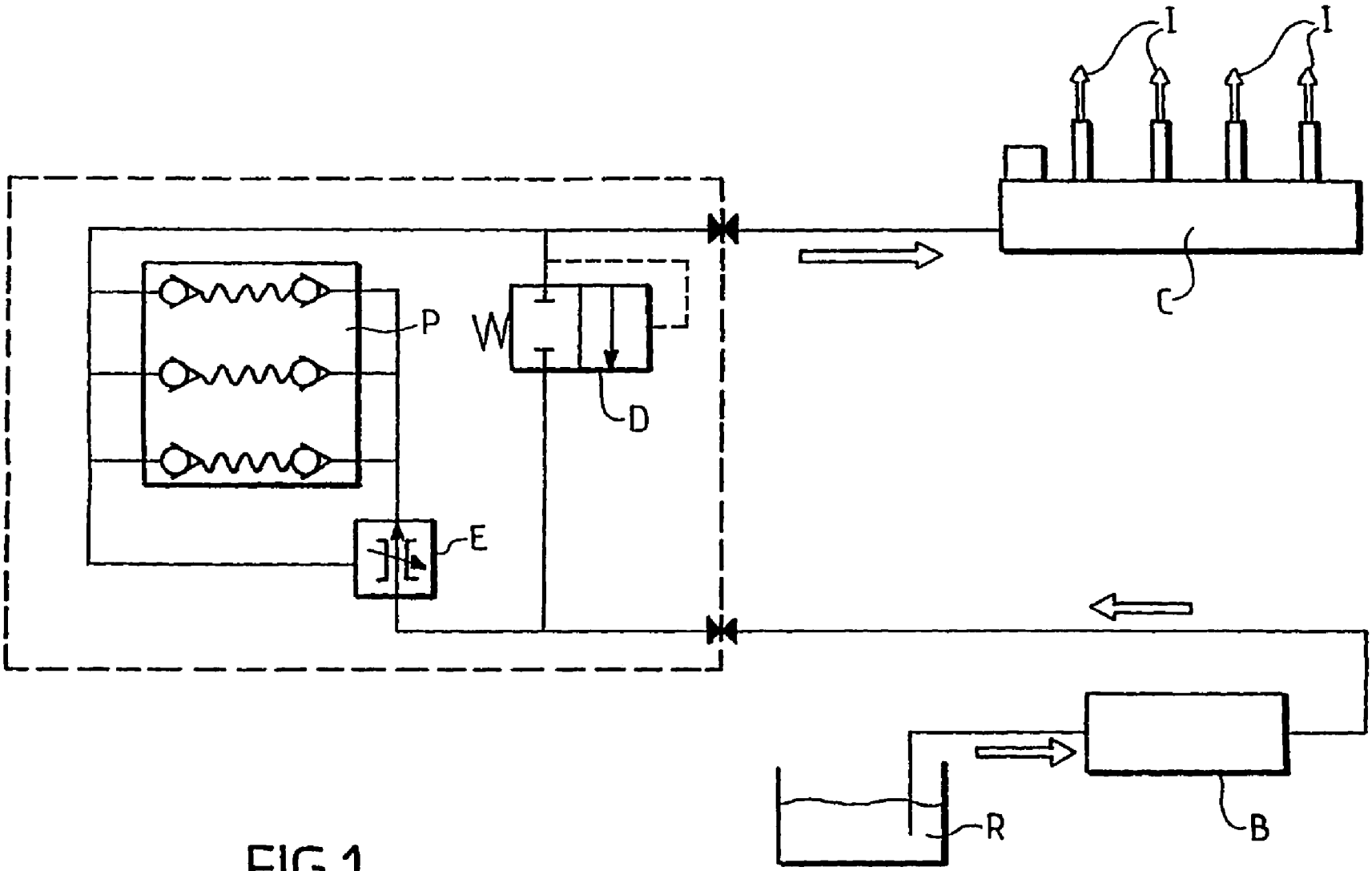

By way of non-limiting example, and to facilitate comprehension of the invention, there has been shown in the accompanying drawings:

FIG. 1 a schematic view of a DFI supply circuit.

Figure 2:
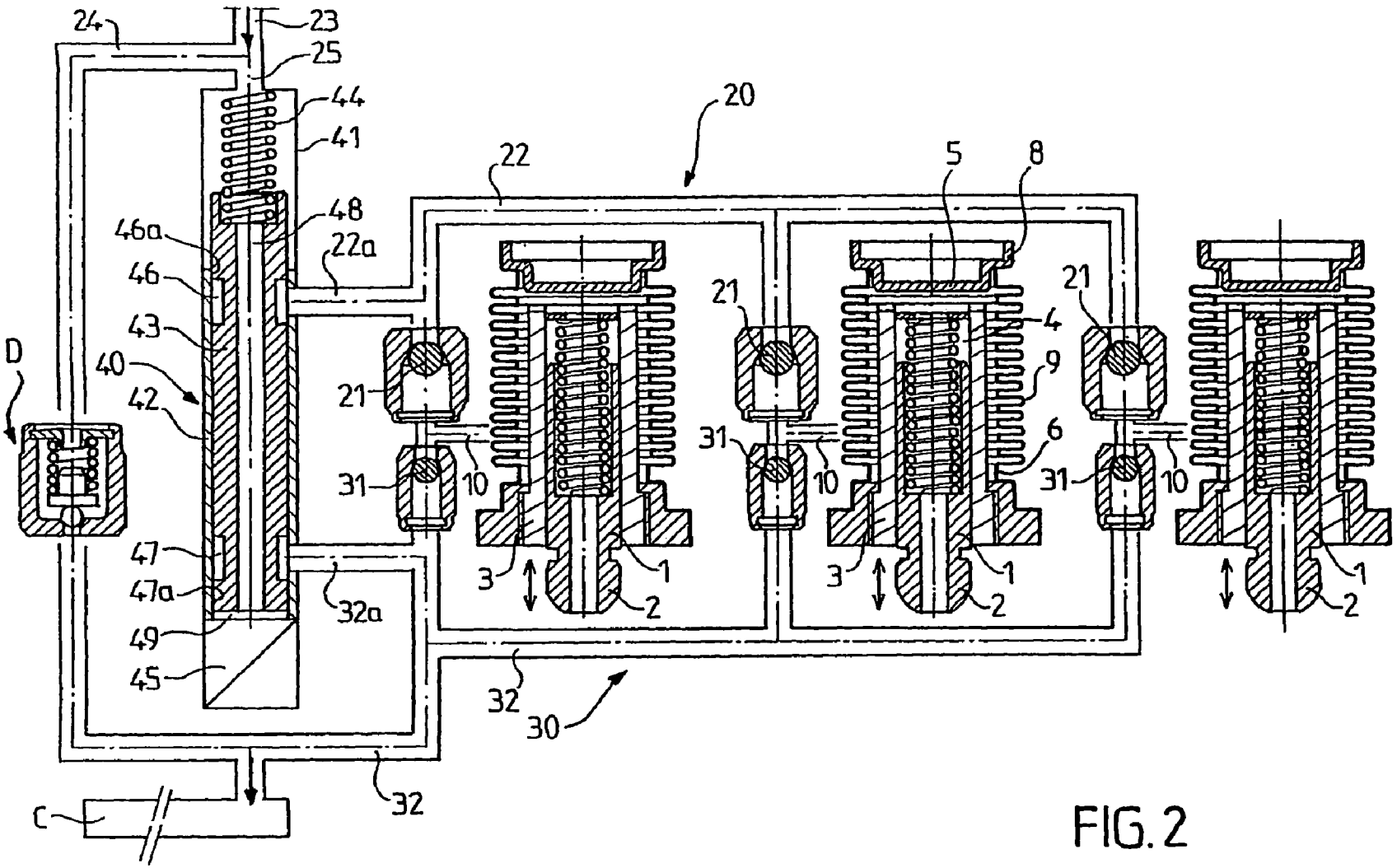

FIG. 2 a view of a pump supplying high pressure fuel provided by a control device according to the invention.

Figure 3:
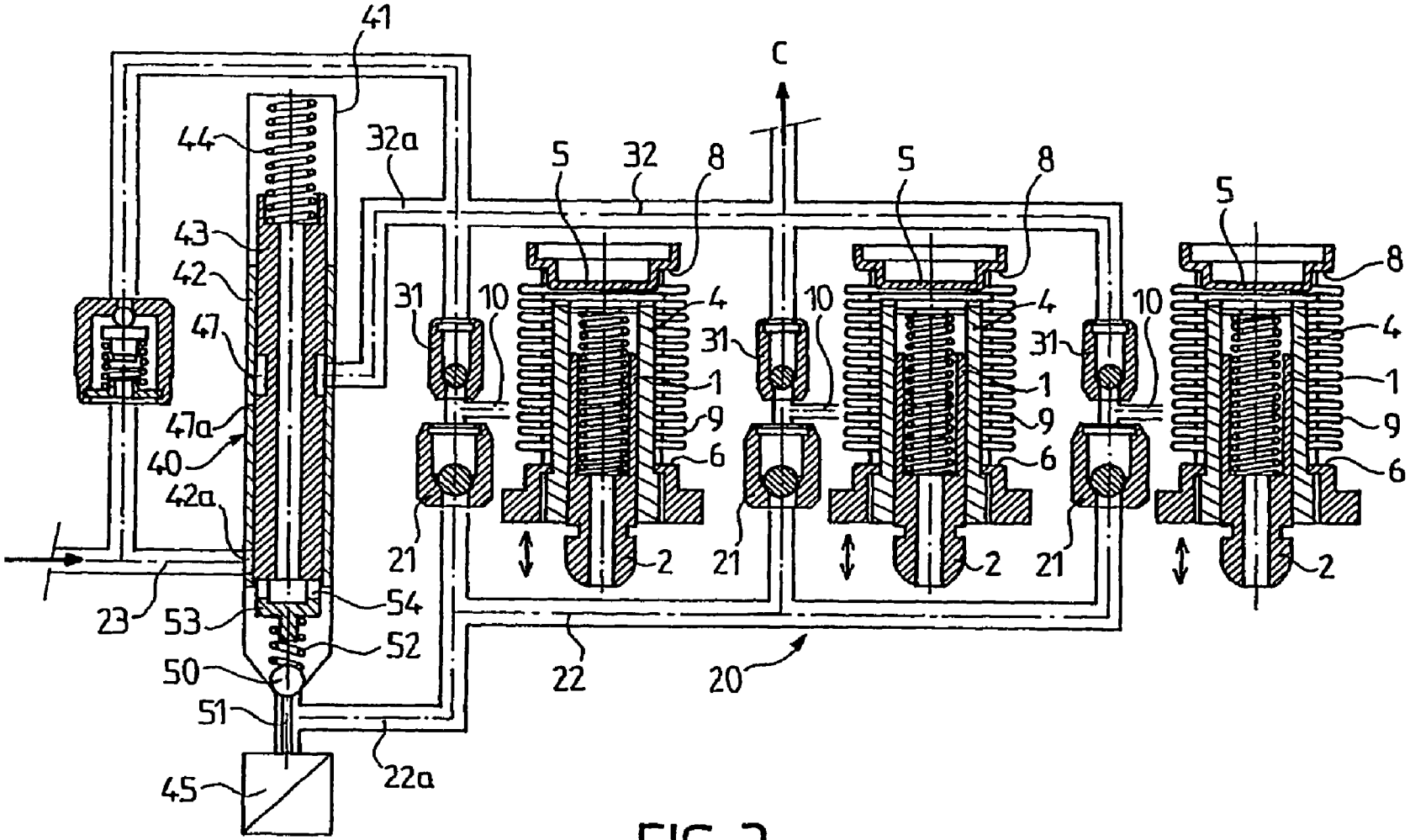

FIG. 3 a view of a second modified embodiment.

Figure 4:
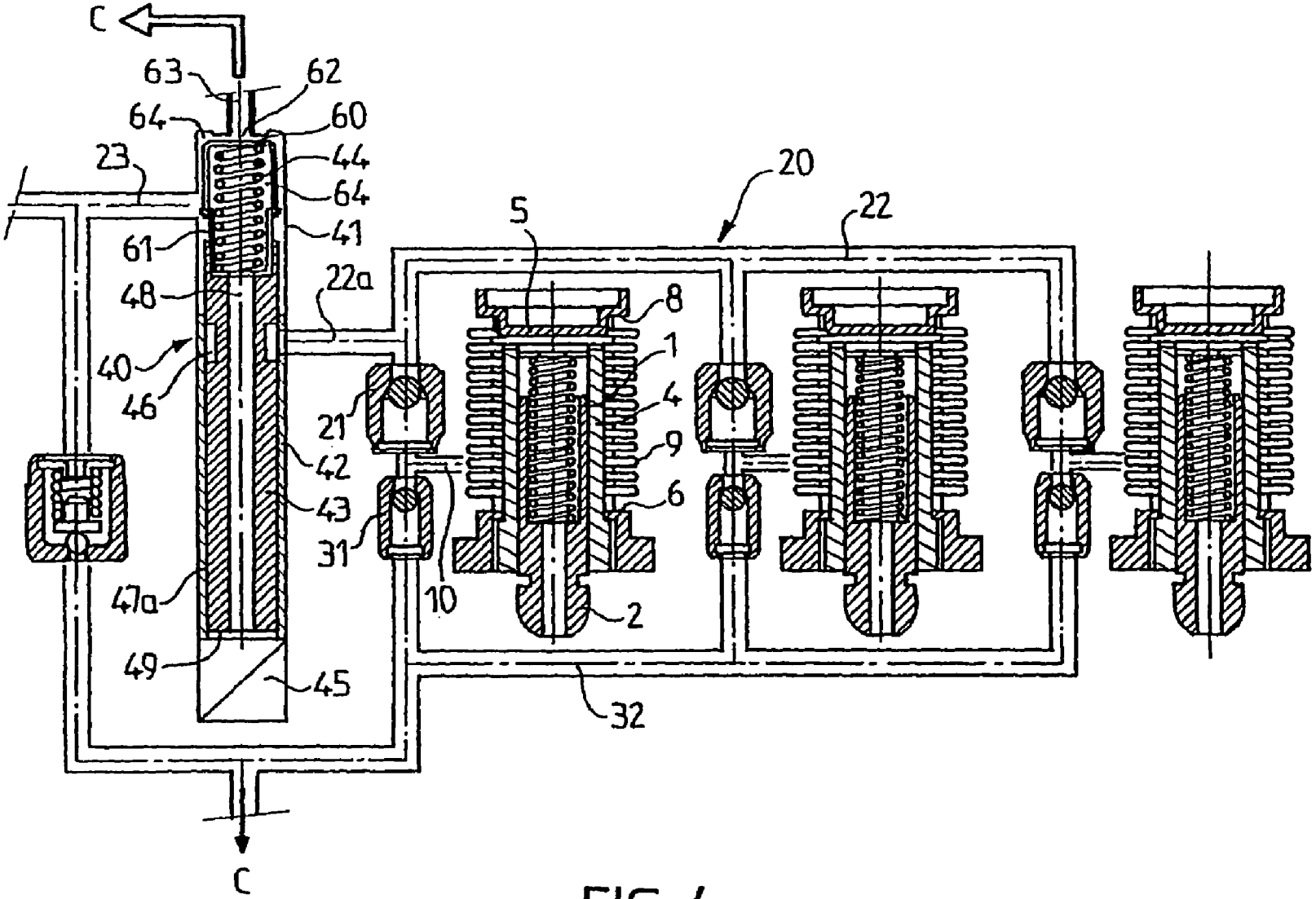

FIG. 4 a view of a third modified embodiment.

Figure 5:
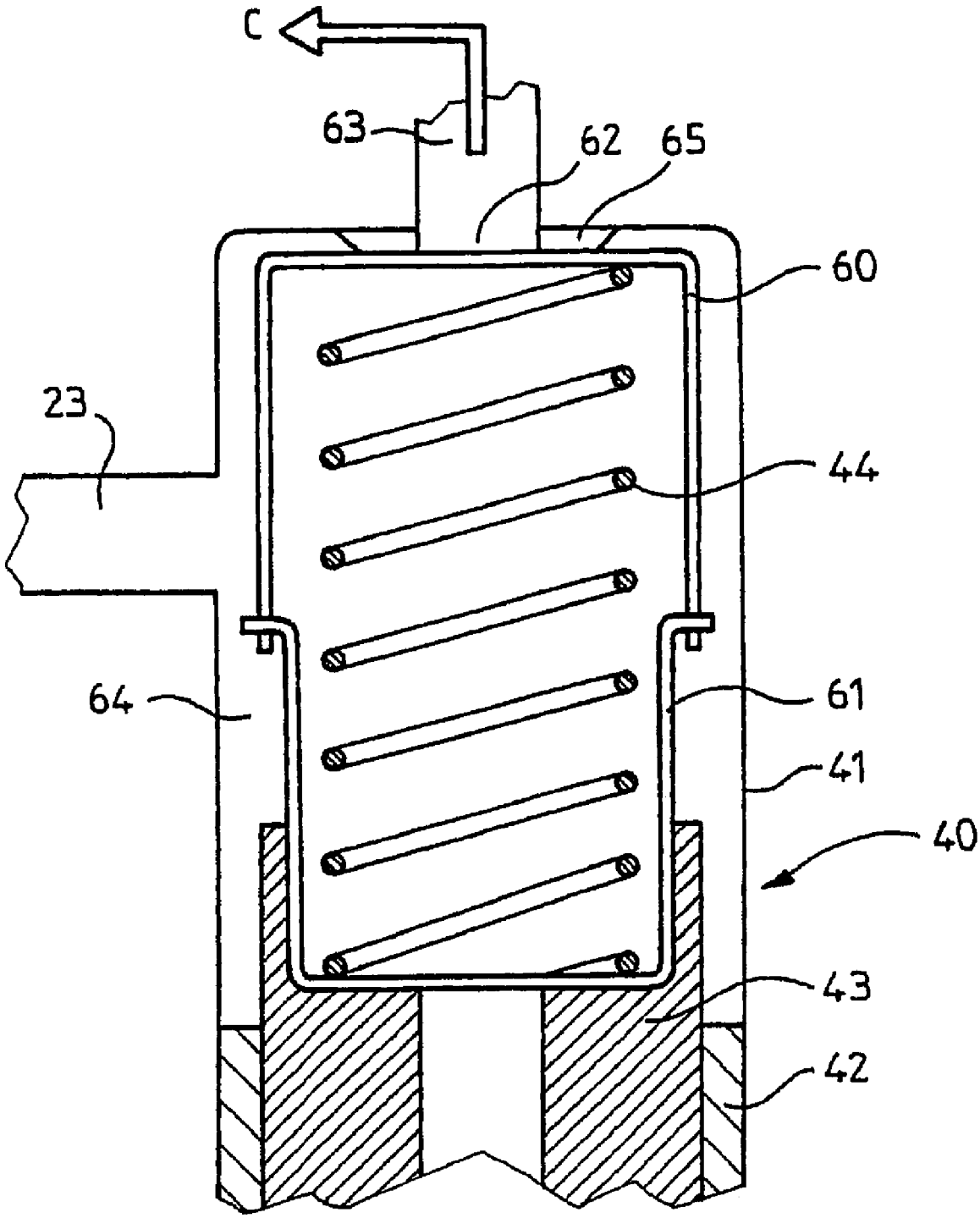

FIG. 5 a fragmentary view of FIG. 4, on an enlarged scale, showing a fourth modification.

Figure 6:
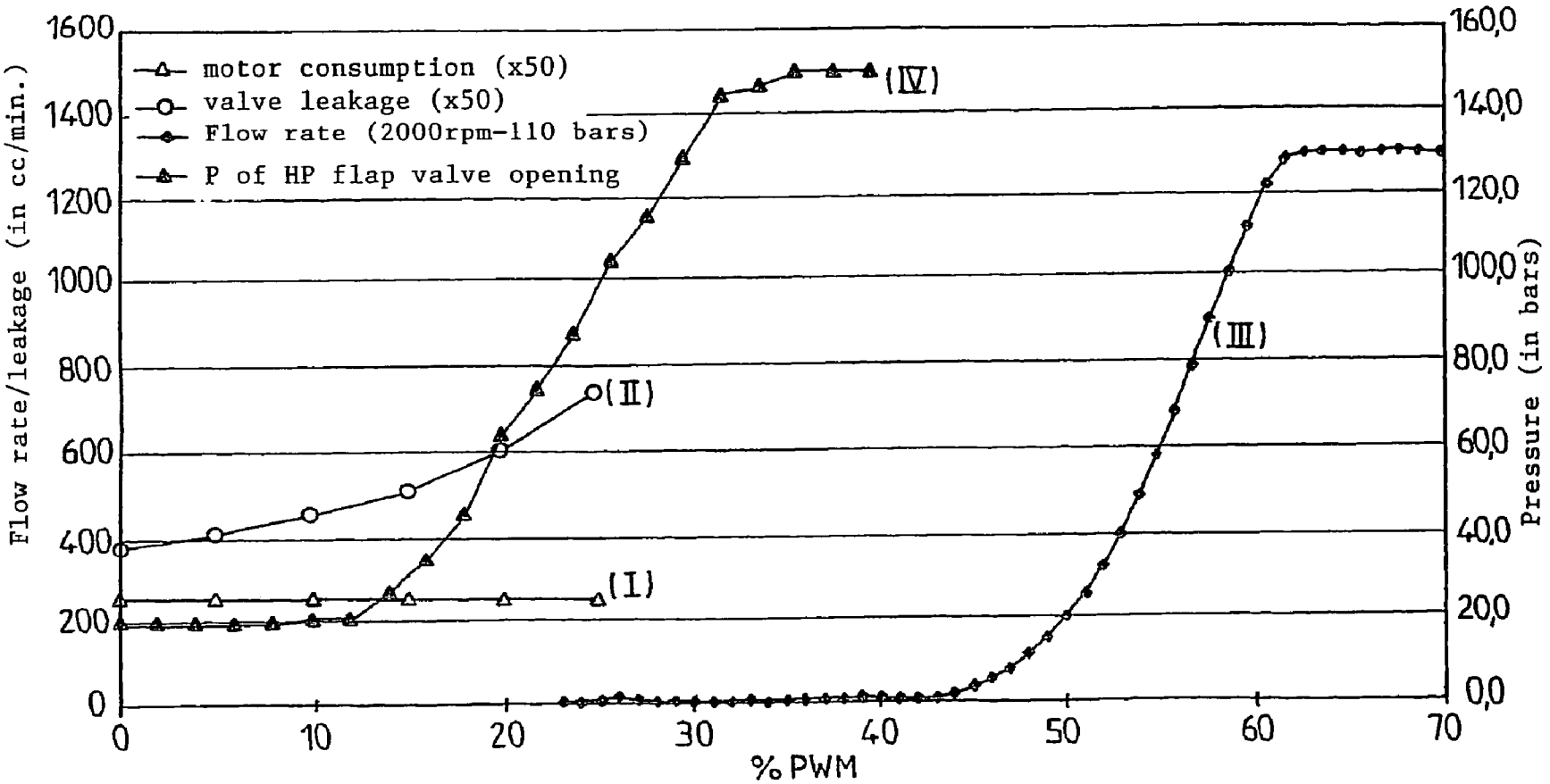

FIG. 6 a diagram showing the operation of the installation.

Figure 7:
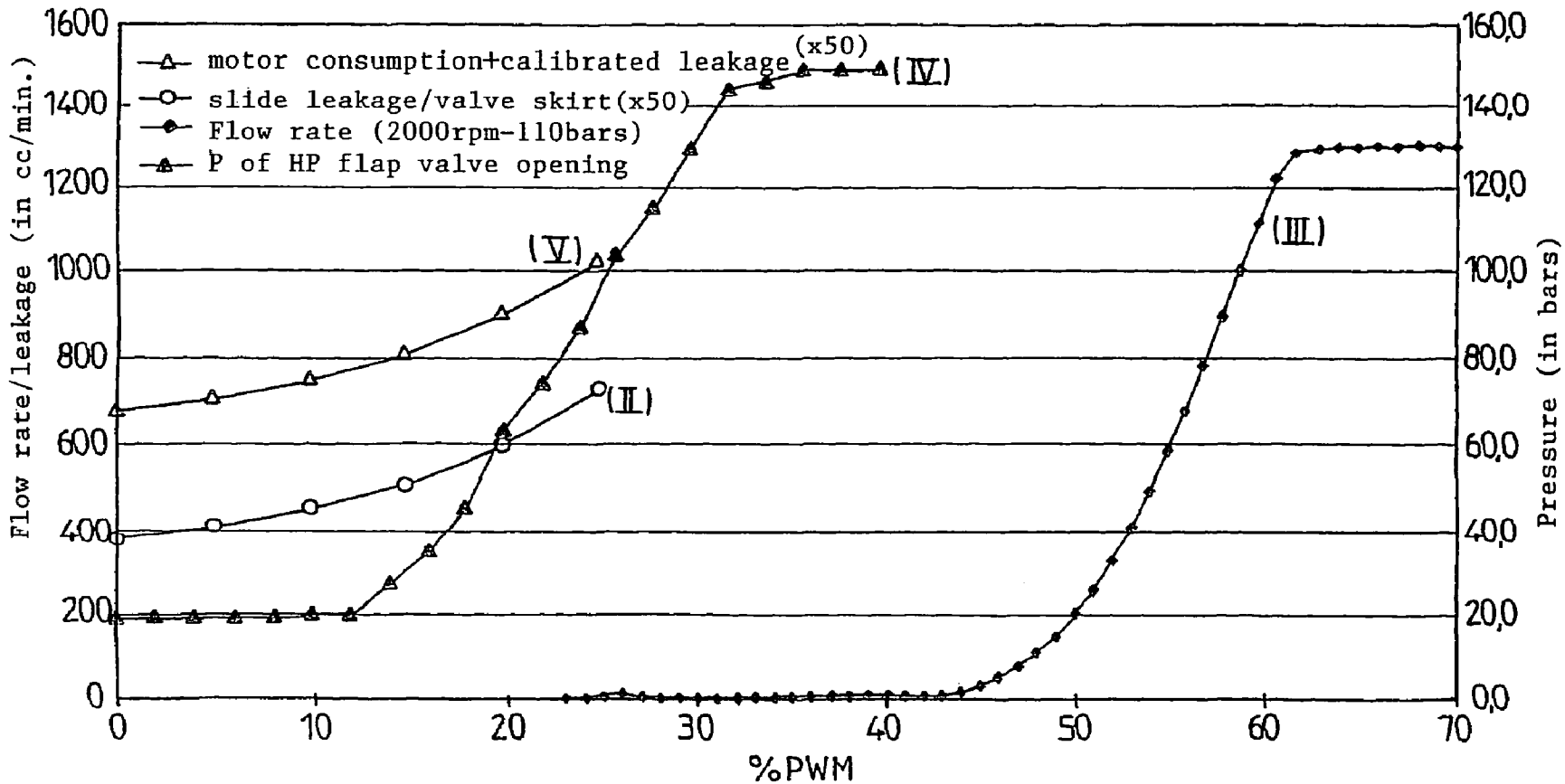

FIG. 7 a diagram showing the operation with an additional leakage path.

Figure 8:
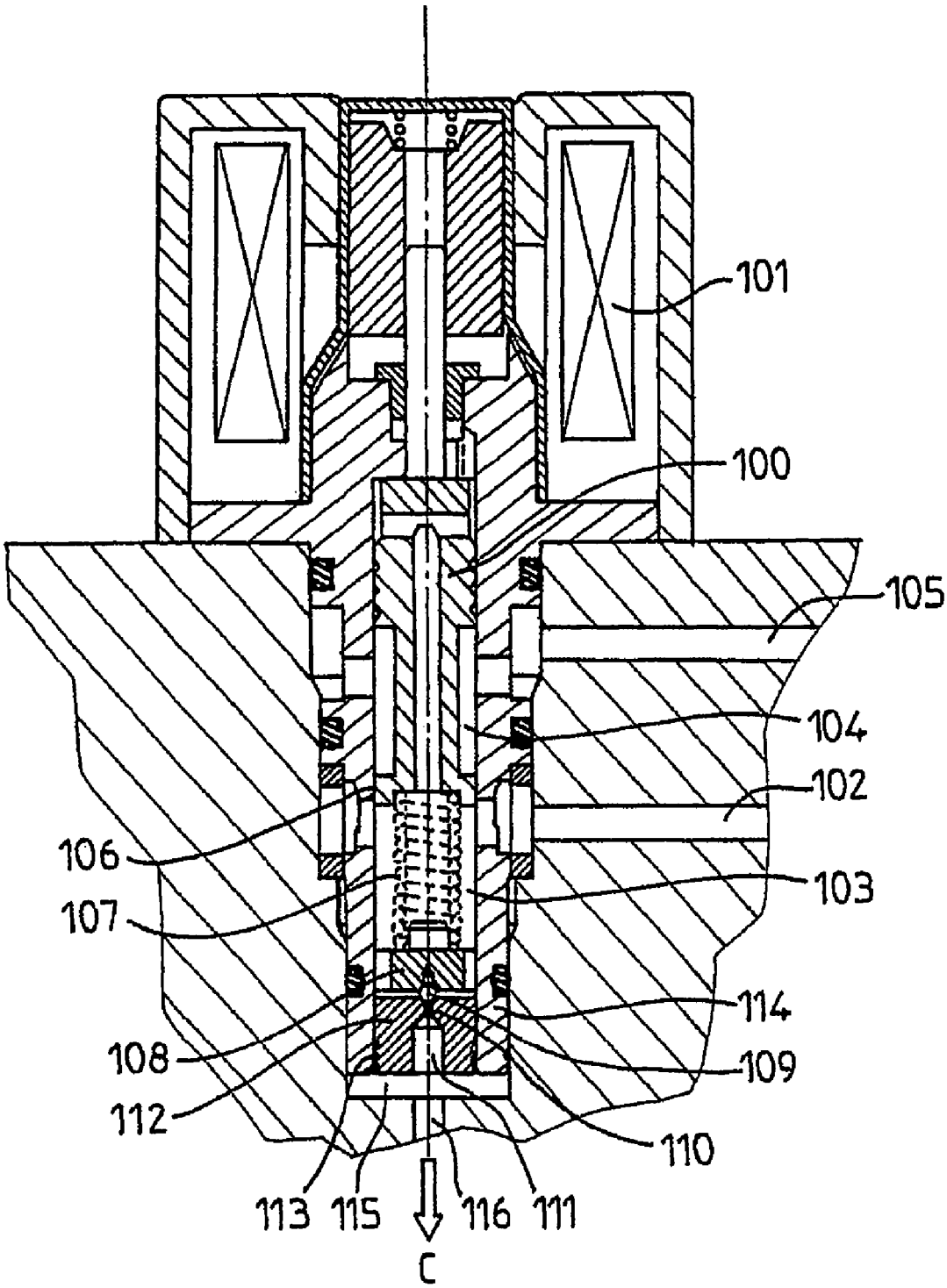

FIG. 8 an example of the practice of the invention.

In all these figures, the same elements have the same reference numerals.

Referring to FIG. 1, it will be seen that the high pressure fuel supply circuit comprises a fuel reservoir R; a low pressure pump or force feeding pump B; an electrovalve E for flow rate control, located upstream of a high pressure pump P; a pressure relief valve D; a high pressure chamber C (usually called a common rail) to which are connected the injectors I.

The pump P can be any type of pump capable of providing the chamber C with gasoline under pressure.

In the example described above (which is not limiting) this pump P is a pump of the so-called transfer pump type, which comprises an oil portion and a gasoline portion which are separated from each other in a sealed manner. The oil, subjected by the pump to an alternative oscillating movement, acts on a deformable element which exerts a pumping action on the gasoline.

The transfer pump is shown schematically in FIGS. 2, 3 and 4 and is not shown in detail because it is well known and is not the subject of the present invention.

The brief description which follows has for its object to facilitate the comprehension of FIGS. 2 to 4.

The oil is subject to alternating back and forth movements by hollow pistons 1. These pistons are given an alternating movement because they bear by their head 2 on an oscillating plate. This oscillating plate is not shown because it is a known means. When a piston 1 moves (upwardly in FIG. 2) in its cylinder 4, the oil raises the flap valve 5. A deformable member 9, in the form of a bellows, is fixed in a sealed manner at one end 6 to the support of the cylinder 4 and at its other end 8 to the flap valve 5. When the piston 1 moves in the reverse direction, the flap valve 5 lowers. As a result, the back and forth movements of the oil give a back and forth movement to said flap valve 5 and hence cause elongations and contractions of the bellows 9.

The bellows 9 is disposed in a chamber full of gasoline. This chamber is not shown because such an arrangement is known. The extensions and contractions of the bellows 9 cause a pumping effect.

Each chamber in which a bellows 9 is disposed comprises a conduit 10 which communicates on the one hand with the low pressure circuit 20 through a non-return flap valve 21 and on the other hand with the high pressure circuit 32 through a non-return flap valve 31.

When the bellows 9 is extended under the force of high pressure of the oil, it presses the gasoline at the same pressure through the flap valve 31; when it retracts, the gasoline supplied by the pump B passes through the non-return valve 21 and enters the chamber in which the bellows 9 is disposed.

There is utilized an upstream regulation of the flow rate of gasoline, by regulating the flow rate of gasoline arriving at the pump P by means of an electrovalve 40 disposed in the inlet channel 23 of the low pressure pump B and distributing the gasoline to the supply circuit 20 of said pump P by a conduit 22*a*.

It is known to persons skilled in the art that, in practice, it is very difficult to produce an electrovalve with a slide having no internal leakage, which is a drawback.

The present invention consists in using this drawback by using internal leakages of the electrovalve 20 to solve the problems set forth above.

To do that, according to a first embodiment, there is attached to the conduit 32, which collects the high pressure from the pump P, a branch 32*a* leading to the electrovalve 40 for regulation of the low pressure flow rate going to the pump, so as continuously to recycle a leakage flow of gasoline under high pressure toward the low pressure circuit through said electrovalve 40.

As can be seen in FIG. 2, the high pressure gasoline from the non-return flap valve 31 is collected by the channel 32, which supplies the chamber C (or common rail). This channel 32 comprises a first branch 32*a* which leads to the electrovalve 40, and a second branch which leads to an overpressure flap valve D.

The electrovalve 40 is constituted by a body 41 in which is disposed a jacket 42 in which slides a slide 43 which is subject on the one hand to a spring 44 and on the other hand to an electromagnet or motor 45. The slide 43 comprises two peripheral throats 47 and 46 which are disposed one facing the inlet 32*a* of the high pressure collector 32, the other to the outlet 22*a* of the low pressure toward the low pressure collector 22.

In normal operation, the throat 46 is uncovered such that the low pressure gasoline arriving by channel 25 communicates with channel 22*a* through the passage provided between the upper end of the jacket 42 and of the throat 46. The size of this passage varies as a function of the position of the slide 43 and it is thus that the flow rate of low pressure gasoline arriving at the pump is regulated as a function of the needs of the motor.

When the electrovalve 45 is not excited, the spring 44 repels the slide 43 and the throat 46 penetrates the jacket 42; the only low pressure gasoline flow rate which arrives at the channel 22*a* is a leakage flow rate, at low pressure, which is the result of the functional play necessary between the jacket 42 and the slide 43.

There is similarly provided a leakage flow rate, but at high pressure, from the throat 47 toward the chamber 49 which is located at the lower end of the body 41 of the electrovalve and which communicates with the low pressure through the central passage 48 which passes through the slide 43.

The internal architecture of the electrovalve 40 is determined such that the leakage flow rate of high pressure gasoline toward low pressure (in 47*a*) will be greater than the leakage flow rate of the low pressure gasoline upstream of the electrovalve toward the low pressure downstream (in 46*a*).

When the motor operates as a motor brake, the electromagnet 45 is no longer excited, but the motor turns, and the pump P is thus driven by the motor to which it is mechanically connected, the supply of low pressure gasoline toward the channel 22 is cut off; but there is a flow rate of gasoline arriving at said channel 22 which is the leakage flow rate via 46*a* of the low pressure upstream to the low pressure downstream.

When the motor is stopped, there remains gasoline under high pressure (about 200 bars) in the channel 32 and the chamber C. This high pressure gasoline will, little by little, discharge itself by the leakage at 47*a* toward the reservoir R.

The respective dimensions of the spaces 46*a* and 47*a* must be determined such that the leakage flow rate making use of the space 47*a* will always be greater (and at least equal) to the leakage flow rate occupying the space 46*a*.

If there is designated by:

Q=the high pressure flow rate arriving at collector 32

Q1=the low pressure flow rate arriving at collector 22

Q2=the low pressure leakage flow rate in 46*a*

Q3=the high pressure leakage flow rate in 47*a* then we have the following equations:

Q=Q1+Q2−Q3 with the following condition: Q2 is negligible

Q=Q1+Q2−Q3 with the following condition: Q3≧Q2 and Q1 is negligible when it is desired to cancel the flow rate Q.

And when the motor is stopped:

Q=Q1+Q2−Q3 with Q1 and Q2 non-negligible, which is to say, a negative flow rate and hence a decrease of the pressure in the rail.

FIGS. 3 and 4 show two other modified embodiments using this process.

According to a first modification (FIG. 3) there is added to the electrovalve with a slide (40-43) a controlled non-return flap valve, which is interposed between the low pressure (LP) upstream and the low pressure (LP) downstream of the electrovalve.

According to a second modification (FIG. 4) there is added a device for regulation of leakage at the high pressure outlet (HP) of the electrovalve.

As before, on the conduit 32, which collects the high pressure from the pump, there is disposed a branch 13*a* leading to the electrovalve 40 for regulation of the low pressure flow rate from the pump, so as to recycle permanently through the space 47*a* a gasoline leakage flow rate under high pressure toward the low pressure circuit through said electrovalve 40.

In the case of the modification shown in FIG. 3, there is a non-return flap valve 50 between the channel LP 23, located upstream of the electrovalve 40 and the LP channel 22*a*, located downstream.

The non-return flap valve 50 is controlled by the electromagnet 45 by means of a push rod 51. The flap valve is counter held in closed position by a spring 52 bearing on a support 53, provided with openings 54; this support 53 being in bearing relationship between the slide 43 and the electrovalve 40.

In the rest position, the electrovalve 40 is closed. The ball 50 rests on its seat in a sealed fashion and the slide 43 covers the supply opening 42*a*. The internal loss of electrovalve 40 is contained in the envelope 41 of the slide 43. This is the "zero flow rate" position, which is to say the prevention of the flow rate Q1+Q2.

In operation, which is to say when the electrovalve 40 performs its regulation task, the electromagnet 45 is actuated; the rod 51 raises the ball 50 and, by means of the support 53, presses the slide 43, which uncovers more or less the opening 42*a* supplied with LP gasoline. This LP gasoline passes through the openings 54 of the support 53 and, the ball 50 being raised, arrives at channel 22*a* which supplies the LP supply conduit 22.

The LP gasoline flow rate arriving at the HP pump is thus regulated.

So as to guarantee a substantially constant piloting effort, a functional set is provided between the ball 50 and the support 53, with the following equation:

$$(LP \times \text{Ball section}) + \text{Spring force } 52 = F \text{ return force } 44.$$

Upon motor stopping, the electromagnet 45 is deactivated, the slide 43 closes the opening 42*a* and the ball 50 returns to its seat.

The high pressure which remains in conduits 32/32*a* will diminish, because of the internal leakage, at 47*a*, of the electrovalve 40 toward the channel 23 such that the remaining pressure HP is progressively discharged.

This modification has the advantage of ensuring a real zero flow rate without leakage of the force feeding pressure (LP) as is the case in the examples of FIG. 2.

On the other hand, as there is no longer leakage on the LP circuit, it is no longer necessary to have a small leakage on the HP, small leakage which has no negative effect on the operation of the high pressure pump.

FIG. 4 shows another modified embodiment, in which the same elements bear the same reference numerals.

The object of this modification is to provide a so-called "function bypass" function, which permits, among other things, short circuiting the HP pump for LP starting.

Under certain starting conditions, the motor starter does not turn fast enough that the HP pump can provide a sufficient flow rate to the injectors.

It is thus interesting to short circuit, at least partially, the pump P so as directly to supply the common rail C with LP gasoline to ensure LP starting.

Referring to this FIG. 4, it will be seen that the return spring 44 of the slide 43 is enclosed in a cage of variable length, constituted by two elements 60/61 that can move toward each other.

The low pressure gasoline from the force feeding pump B through the channel 23 arrives laterally into the chamber 64 in which is located the cage 60/61, which encloses the return spring 44.

This chamber 64 comprises at its upper end an opening 62 which communicates through a channel 63 with the rail C and hence the HP which is located there.

At rest, the pieces are in the position shown at FIG. 4.

The low force feeding pressure arriving through the channel 23 enters the chamber 64 of the electrovalve 44 and communicates via the opening 62 and the channel 63 with the rail C. This ensures the bypass operation set forth above; on the other hand, this also ensures the operation of discharging the common rail C in case of stopping.

At the beginning of regulation, the electrovalve 45 pushes back the slide 43 and the cage 60/61 closes the opening 62 and hence the communication between the LP inlet and the rail C. If the flow rate supplied by the HP pump is greater than the flow rate consumed by the motor (valve leakage for example) the pressure in the HP circuit rises, and an HP rail loss toward LP is regulated through the opening 62. The excess flow rate is thus recycled to the LP.

In the narrow regulation phase, the electromagnet 45 pushes the slide 43 back, which compresses the spring 44 to which the portion 60 of the cage 60/61 is applied, against the opening 62, which is thus closed; upon returning, the slide 43 causes the channel 23 to communicate with the throat 46 connected to the channel 23*a*. The BP gasoline flow rate arriving at the HP pump is thus regulated.

Obviously, it is necessary to avoid inopportune opening of the opening 62, and to do this it is necessary to fix the cross-section of the opening 62 such that when the electrovalve 45 applies by means of the slide 43 the portion 60 of the cage against the opening 62, this latter will be dimensioned such that the maximum pressure of the HP multiplied by said cross-section, will be lower than the load in place of the spring 44.

In FIG. 6 there are shown four curves (I), (II), (III) and (IV), given by way of example.

The abscissa is graduated as a percentage of PWM (Pulse Width Modulation) which is the usual control means for an electrovalve by modification of the width of the pulses arriving at the motor 45.

There are two scales on the ordinate, one on the left side, which is a scale of flow rate in cc/min; the other on the right side which is a scale of pressure in bars.

The curve (I) represents consumption of the idling motor: it is thus constant.

Curve (II) represents the leakage flow rate through the electrovalve: it increases with PWM (decrease of the drawer/skirt recovery).

Curve (III) represents the increase of flow rate as a function of PWM.

Curve (IV) represents the pressure necessary to open the flap valve 60/62 toward the common rail C as a function of PWM.

It will be seen that curve (IV) is not shown from 40% PWM. This means that beyond this latter, the force exerted by the spring 44, because of the collapse caused by the movement of the slide (upward in FIG. 4) controlled by the motor 45, is such that the flap valve 60/62 cannot open, the portion 60 of the cage 60/61 remaining applied against the opening 62.

Examination of curves (I) and (II) shows that, at idling, the flow rate of the internal loss of the electrovalve is greater than the consumption of the motor. As a result, the computer which controls the motor will control the PWM such that the flap valve 60/62 can open and that the excess of gasoline from the internal leakage will be returned to the upstream LP.

In this case, as the flap valve 60/62 is opened, the HP which is sent to the common rail C through the channel 32, returns through the channel 63 toward the channel 23, through the chamber 64 of the electrovalve 40; because the pressure prevailing in the common rail C and thus in the channel 63 is greater than that prevailing in the channel 23.

There is thus a reversal of the circulation of the gasoline during stopping of the motor.

This possibility of reversal of the circulation of the motor can be very interesting.

Thus, it permits lowering the high pressure in the common rail C for very particular operating modes of the motor.

In the systems in service at present, when it is desired to lower the high pressure, the mixture is enriched, which increases the consumption and thus lowers the pressure; but this is wasteful.

Thanks to the device according to the invention, the supply can be cut and have a negative flow rate which returns to the reservoir and causes the pressure to fall in the common rail C.

This arrangement, although satisfactory, can be improved.

Thus it is noted that it is very difficult to obtain sufficient precision by such regulation, which uses springs and flap valves: there can thus result, upon idling, irregularities of supply of the injectors which means that the motor will not have a stable operation but "hiccup".

To eliminate this drawback, there is provided, according to the invention, an additional permanent leakage flow rate in the valve toward the common rail C, which is to say in the valve 60/62.

Referring to FIG. 5, it will be seen that the portion 60 of the cage 60/61 does not rest directly against the opening 62, but on a seat 65 in which there is provided one or several conduits precisely calibrated so as to ensure a permanent calibrated leakage flow through said seat 65.

Referring then to FIG. 7, it will be seen that the curve (I) has been replaced by the curve (V) which represents a consumption of the idling motor+the leakage flow rate through the calibrated opening for leakage through the seat 65.

It will thus be seen that the curve (V) is always below the curve (II), which is to say that the consumption of the idling motor added to the permanent leakage flow rate is greater than the internal leakage of the electrovalve.

As a result, there is a deficit of the LP gasoline flow rate arriving at the pump; hence the common rail C will not be sufficiently supplied; this causes the pressure in the common rail C to lower; this decrease of pressure will be detected and transmitted to the computer which will increase the PWM, which is to say cause the slide 43 of the electrovalve 40 to move, to increase the LP flow rate by moving toward the foot of the curve III.

The adjustment of the flow rate being much more precise than the regulation of the pressure, there is thus obtained an excellent control of idling.

This result is obtained at the price of a loss of overall output of the pump; but this loss is very low and considered as negligible relative to the result obtained.

FIG. 8 shows an example of embodiment of the device shown schematically in FIGS. 5 and 6.

The electrovalve comprises a slide 100 (corresponding to the slide 43) which is actuated by a motor 101 (corresponding to 45). The upstream LP, from the reservoir thanks to the force feeding pump, arrives through the channel 102 (corresponding to 23), in a chamber 103 (corresponding to 64). The downstream LP, from the internal leakage flow, is collected in the throat 104 (corresponding to 46) and is directed toward the intake of the HP pump through the channel 105 (corresponding to 22*a*). The internal leakage of the upstream LP to the downstream LP takes place in the zone indicated at 106, between the chamber 103 and the throat 104. The slide is counteracted by a spring 107 (corresponding to the spring 44) which is located in the chamber 103.

The spring 107 is disposed between the slide 100 and a pusher 108 bearing a ball 109 which will close a small channel 110 which opens into a channel 111 which communicates with the common rail C. The channels 110 and 111 are arranged through a member 112 which is fixed to the skirt 114 (corresponding to 42) in which slides the slide 100.

The piece 112 is fixed at the end of the skirt 114 by providing a calibrated passage 113 permitting a permanent leakage.

The channel 111 and the calibrated leakage 113 open into a chamber 115 which, through a channel 116 (corresponding to 63), communicates with the common rail C.

The ball 109 on its seat of the channel 110 and the calibrated passage 113 correspond to the flap valve 60/62 and to the leakage 65 of FIG. 6.

The electrovalve shown in FIG. 8 corresponds exactly to that of FIGS. 4 and 5 and its operation is identical.

The invention claimed is:

1. Process for controlling the supply of high pressure (HP) gasoline of a set of injectors connected to a common high pressure chamber, called a "common rail" (C) in a direct fuel injection circuit, called DFI, by a high pressure pump (P), comprising steps of:

acting on a low pressure (LP) supply of said pump (P) by means of a slide electrovalve (E), controlled by a computer allowing an internal leakage from an upstream low pressure, arriving at the electrovalve (E), toward a downstream low pressure, toward the pump (P), and providing in said electrovalve (E) a high pressure (HP) leakage of the gasoline, located in the common rail (C), toward the upstream low pressure.

2. Process according to claim 1, wherein the electrovalve (E) comprises a chamber (64) receiving the upstream low pressure, the chamber being connected to the common rail (C) by means serving as a non-return valve of calibrated passage, so that under certain conditions of operation of the motor, the gasoline located at low pressure in the common rail can be returned to the low pressure upstream inlet.

3. Device for practicing the process according to claim 2, of the type comprising:

low pressure gasoline supplied by a low pressure pump (B) acting in a reservoir (R);

a high pressure pump (P);

a common rail (C) supplied by the high pressure pump; and an electrovalve (E) regulating the supply of the low pressure gasoline to said pump (P), an upstream low pressure inlet connecting the pump (B) to the electrovalve;

a downstream low pressure conduit connecting the electrovalve to the high pressure pump (P);

said electrovalve (E) comprising:

a slide (43) slidably disposed in a jacket (42) so as to cause the upstream low pressure inlet (23) to communicate with the downstream low pressure conduit (22*a*) supplying the pump (P) by means of a throat (46) provided in the slide (43);

a chamber (64) into which the upstream low pressure inlet opens;

an orifice (62) connecting the chamber (64) to the common rail by a channel (63);

a deformable cage (60, 61) disposed in the chamber so as to be able to controllable rest against the seat so as to controllably open or close the orifice, calibrated openings allowing some flow to the channel (63) even when the deformable cage is positioned to close the orifice;

a spring (44) disposed in the deformable cage to apply force to the slide;

a motor (45) disposed to move the slide against the spring force;

wherein the slide, jacket, and throat are constructed and arranged so that a leakage flow occurs between the upstream low pressure inlet (23) and the downstream low pressure conduit (22*a*) by means of play between the skirt (42) and the slide (43), wherein, as a function of the demand on the motor, a communication can be established between the reservoir (R) and the common rail (C) by the upstream low pressure inlet (23) and channel (63) through at least one of the orifice (62) and the calibrated openings.

4. Device according to claim 3, further comprising a seat (65) against which rests a movable portion (60) of the deformable cage (60/61); said seat (65) being traversed by at least one of the calibrated openings so as to ensure through said seat (65) a calibrated permanent leakage.

5. Device according to claim 3, in which the slide (43) of the electrovalve (E) is traversed by a passage (48).

6. Device according to claim 4, in which in normal operation of the motor, the low pressure gasoline provided by the low pressure pump (B) passes through the electrovalve by passing through the throat (46), which is opened by the movement of the slide (43) moved by the motor (45) against the spring (44) which applies a portion (60) of the cage against the orifice (62).

7. Device according to claim 3, in which when the motor is stopped, residual high pressure prevailing in the common rail (C) flows toward the reservoir (R) through the calibrated openings, the chamber (64) and the upstream low pressure inlet (23).

8. Device according to claim 3, in which when the motor acts as a motor brake, the injectors are closed, but the pump (P) is still driven and pumping the leakage flow from the upstream low pressure to the downstream low pressure, the high pressure increases in the common rail and presses back the cage (60) by opening the orifice (62) so as to be returned to the reservoir (R).

9. Device according to claim 3, in which when the motor turns idly, excess high pressure gasoline provided by the pump (P) is returned to the reservoir (R) through the channel (63), the orifice (62) and the upstream low pressure inlet (23).

* * * * *